US005602923A

United States Patent [19]

Ozaki et al.

[11] Patent Number: 5,602,923

[45] Date of Patent: Feb. 11, 1997

[54] THEATER SOUND SYSTEM WITH UPPER SURROUND CHANNELS

[75] Inventors: Yoshio Ozaki, Tokyo, Japan; Michael J. Kohut, Ojai, Calif.

[73] Assignees: Sony Corporation, Tokyo, Japan; Sony Cinema Products Corporation, Culver City, Calif.

[21] Appl. No.: 518,624

[22] Filed: Aug. 23, 1995

Related U.S. Application Data

[62] Division of Ser. No. 207,006, Mar. 7, 1994.

[51] Int. Cl.[6] ..... H04R 5/00

[52] U.S. Cl. ..... 381/18; 381/19; 381/23; 381/20

[58] Field of Search ..... 381/24, 1, 22, 381/18, 19, 20, 21, 23; 358/341

[56] References Cited

U.S. PATENT DOCUMENTS 4,549,236 10/1985 Fujiki ..... 358/341
5,199,075 3/1993 Fosgate ..... 381/18

*Primary Examiner*—Curtis Kuntz
*Assistant Examiner*—Minsun Oh
*Attorney, Agent, or Firm*—Jerry A. Miller; Charles J. Kulas

[57] ABSTRACT

An improved theater surround sound system incorporates a screen top speaker and an overhead speaker driven by corresponding upper surround channels to more accurately reproduce sounds produced from above the listener. These top surround channels are encoded along with the left and right surround channels. A pilot signal is used to direct the sound from the side surround channels to the upper surround channels when needed.

9 Claims, 6 Drawing Sheets

THEATER SOUND SYSTEM WITH UPPER SURROUND CHANNELS

This application is a division of Ser. No. 08/207,006, filed Mar. 7, 1994 which is hereby incorporated by reference.

CROSS REFERENCE TO RELATED DOCUMENTS

This application is related to U.S. patent application Ser. No. 08/054,765 to Jeffrey Taylor et al. which describes a printer module for reproducing digitally encoded motion picture film suitable for use in the present invention. This application is also related to U.S. patent application Ser. No. 08/054,560 to Richard Weisman which describes an improved film trap for use in motion picture projectors which is used to project film with digital format audio. This application is also related to U.S. application Ser. No. 07/896,412 to Michael Kohut, et al. which relates to a method and apparatus for photographically recording digital audio. This application is also related to U.S. application Ser. No. 07/896,229 to Michael Kohut, et al. which relates to a method and apparatus for reading photographically recorded digital audio. These applications are hereby incorporated by reference.

BACKGROUND

1. Field of the Invention

This invention relates generally to the field of multiple channel audio systems. More particularly, this invention relates to a method and apparatus for providing an improved surround sound system having overhead channels to provide a more realistic three dimensional sound which is particularly advantageous to theater applications such as movie theaters.

2. Background of the Invention

Conventional theater surround sound systems include a plurality of speakers distributed across the front of the theater with surround speakers located along each side of the theater. This is illustrated in detail in FIG. 1 which shows an example speaker layout within such a theater. In this arrangement, the movie screen 20 is located on or near a front wall 22. The movie screen typically covers an array of speakers. The array of speakers includes a left channel speaker 24, a left center channel speaker 26, a center channel speaker 30, a right center channel speaker 34 and a right channel speaker 38. Also shown is a sub-woofer 42 which reproduces the extreme lower frequency sounds. Left and right surround speakers 48 and 52 are mounted on side walls 56 and 58 of the theater respectively to produce the effect of surrounding the audience in the seating area 64.

The audio information needed for reproduction of the above channels is optically encoded using, for example, the Sony Dynamic Digital Sound SDDS™ format or the Dolby SRD format. In the SDDS™ format, digital data representing the eight audio channels are optically encoded between the film perforations and the film edge. Eight channel surround sound can also be encoded using other encoding formats including the methods described in PCT application number WO92/14239 assigned to Dolby Laboratories Licensing Corporation, which is hereby incorporated by reference.

The speaker arrangement of FIG. 1 provides for a realistic surround sound for most situations. However, the two dimensional speaker arrangement of FIG. 1 is best suited for reproduction of two dimensional sound sources. There are many real life situations in which sound comes from above the listener, for example, when an airplane or helicopter passes overhead at low altitude, or the launching of a rocket or missile. This type of sound cannot be completely accurately simulated using the conventional surround arrangement of FIG. 1 with a substantial degree of realism since the listener expects to detect that the source of the sound is overhead. It is therefore desirable to provide for one or more channels of sound to be produced by speakers mounted over the listener's head. Unfortunately, in a theater environment, this must be accomplished under the constraints of the bandwidth available in the 35 mm film format which is common to most theaters.

It is also desirable to provide the improved audio quality accompanying use of digital audio technology as in Sony's SDDS™. Unfortunately, these digital technologies are pushing the bandwidth limits of current motion picture film technology in order to obtain the eight channels of information required to drive the speaker arrangement of FIG. 1. Accordingly, there is a need to provide a mechanism for encoding additional channels without use of additional bandwidth.

SUMMARY OF THE INVENTION

It is an object of the present invention to provide an improved surround sound.

It is another object to provide such improved surround sound using digital technology to produce digital audio quality.

It is another object to provide a method of encoding additional audio channels on motion picture film or other media.

It is a feature that the present invention to provides one or more channels of information for driving upper channel speakers to produce an enhanced surround effect.

It is an advantage that the present invention achieves the additional channels within the 35 mm film format constraints.

It is a further advantage that the present invention provides realistic reproduction of audio signals which come from above the head of the listener.

These and other objects, advantages and features of the invention will become apparent to those skilled in the art upon consideration of the following description of the invention.

The present invention generally relates to an improved theater surround sound system which incorporates a screen top speaker and an overhead speaker driven by corresponding upper surround channels to more accurately reproduce sounds produced from above the listener. These top surround channels are encoded on the film by mixing these top surround channels with the left and right surround channels. A pilot signal is also mixed with these channels and is used to direct the sound from the side surround channels to the upper surround channels when needed.

A multi-channel audio system, according to the present invention includes a source of audio information having at least: a plurality of main channels including at least a left channel and a right channel, a plurality of surround channels including at least a left surround channel, a right surround channel and at least one upper surround channel. An encoder encodes each of the main channels and surround channels in a recording medium. A decoder decodes each of the main and surround channels from the recording medium.

A method of audio recording according to this invention, includes the steps of: providing a channel of audio information suitable for serving as a source of side surround audio and upper surround audio; producing a pilot signal having a characteristic representative of a desired proportion of the channel which should be allotted to the side surround audio and the upper surround audio; and recording the pilot tone and the channel of audio.

A method of recording two channels of audio, according to this invention, includes the steps of: mixing a first channel of audio with a second channel of audio in a predetermined proportion to produce a mixed channel; producing a pilot signal having a characteristic representative of the predetermined proportion; and recording the pilot tone and the first and second channel of audio.

Another method of processing an audio signal according to the invention includes the steps of: receiving a composite signal including a first audio signal, a second audio signal and a pilot signal; removing the pilot signal from the composite signal to produce a mixed audio signal; determining a predetermined characteristic of the pilot signal; and routing the mixed audio signal to a first channel and a second channel in a proportion determined by the predetermined characteristic of the pilot signal.

In an improved theater sound system according to an embodiment of the present invention, a decoder decodes encoded audio signals on a motion picture film into: a right channel, a right center channel, a left channel, a left center channel, a center channel, a sub-woofer channel, a right surround channel, and a left surround channel. The right surround channel is separated into a first control signal and a first audio signal. The right surround channel is divided into two channels under control of the first control signal. The left surround channel is separated into a second control signal and a second audio signal. The left surround channel is separated into two channels under control of the second control signal.

A system for encoding theater sound according to the present invention includes an encoder for encoding audio signals on a motion picture film representing: a right channel, a right center channel, a left channel, a left center channel, a center channel, a sub-woofer channel, a right surround channel, and a left surround channel. A first pilot signal is mixed with the right surround channel. The first pilot signal represents an amount of the right surround channel to be diverted to a first upper surround channel. The second pilot signal is mixed with the left surround channel. The second pilot signal represents an amount of the left surround channel to be diverted to a second upper surround channel.

An apparatus for encoding surround sound according to an embodiment of the present invention, includes an oscillator for producing a 19 Khz pilot signal. A mixer mixes the pilot signal with a surround signal in a proportion related to a desired distribution of the surround signal between a side channel and an upper channel. An encoder optically encodes the output of the mixer onto motion picture film.

An apparatus for decoding surround sound according to an embodiment of the present invention, includes a decoder for decoding optically encoded audio from motion picture film to produce a decoded signal. A pilot signal detector detects a signal level of a pilot signal forming a part of the decoded signal. The decoded signal is distributed to a side surround channel ad an upper surround channel in proportion to the level of the pilot signal.

The features of the invention believed to be novel are set forth with particularity in the appended claims. The invention itself however, both as to organization and method of operation, together with further objects and advantages thereof, may be best understood by reference to the following description taken in conjunction with the accompanying drawing.

DETAILED DESCRIPTION OF THE INVENTION

Figure 1:
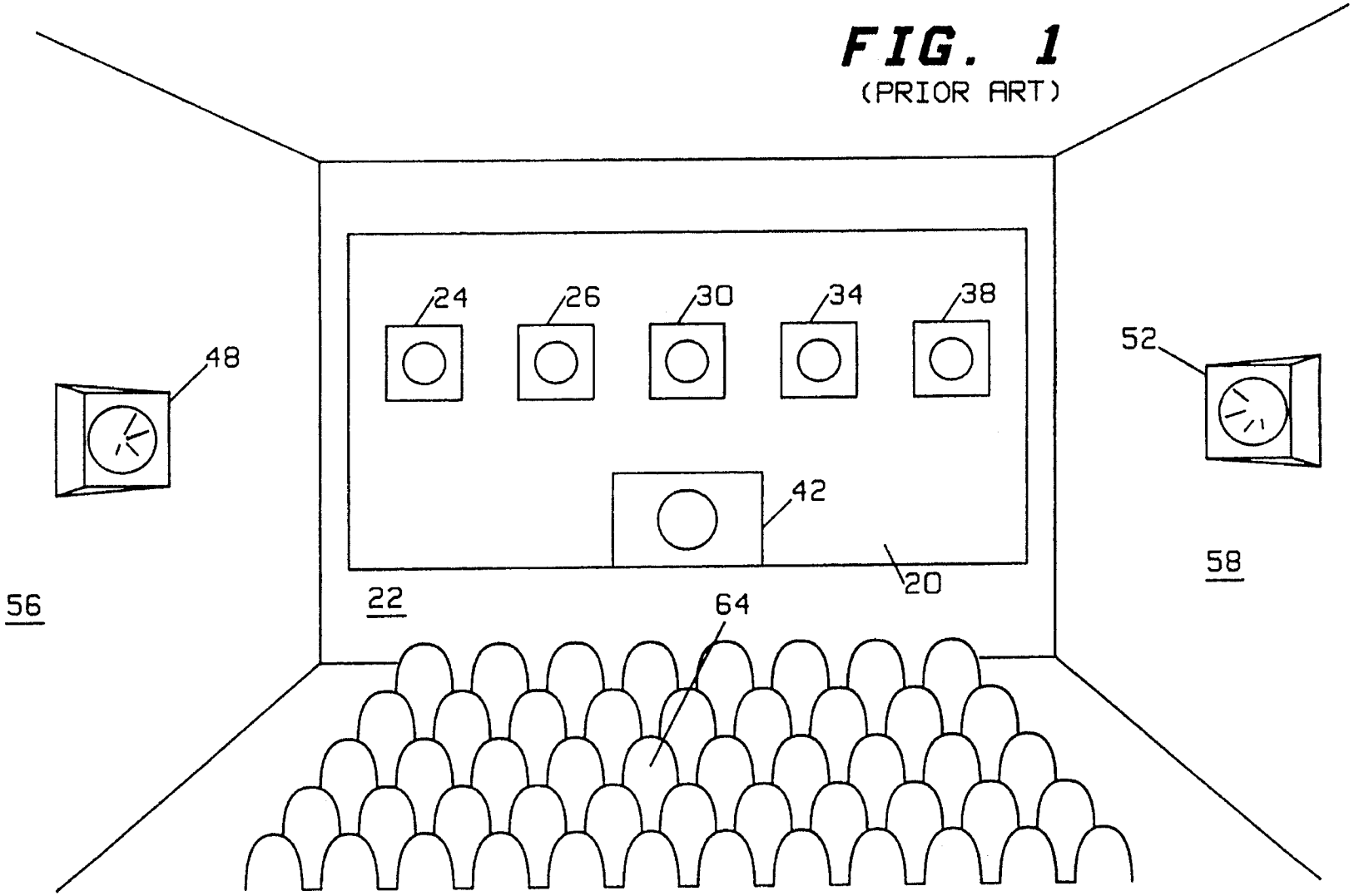
FIG. 1 (PRIOR ART)
FIG. 1 is an illustration of a theater layout for conventional surround sound.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawing.

Figure 2:
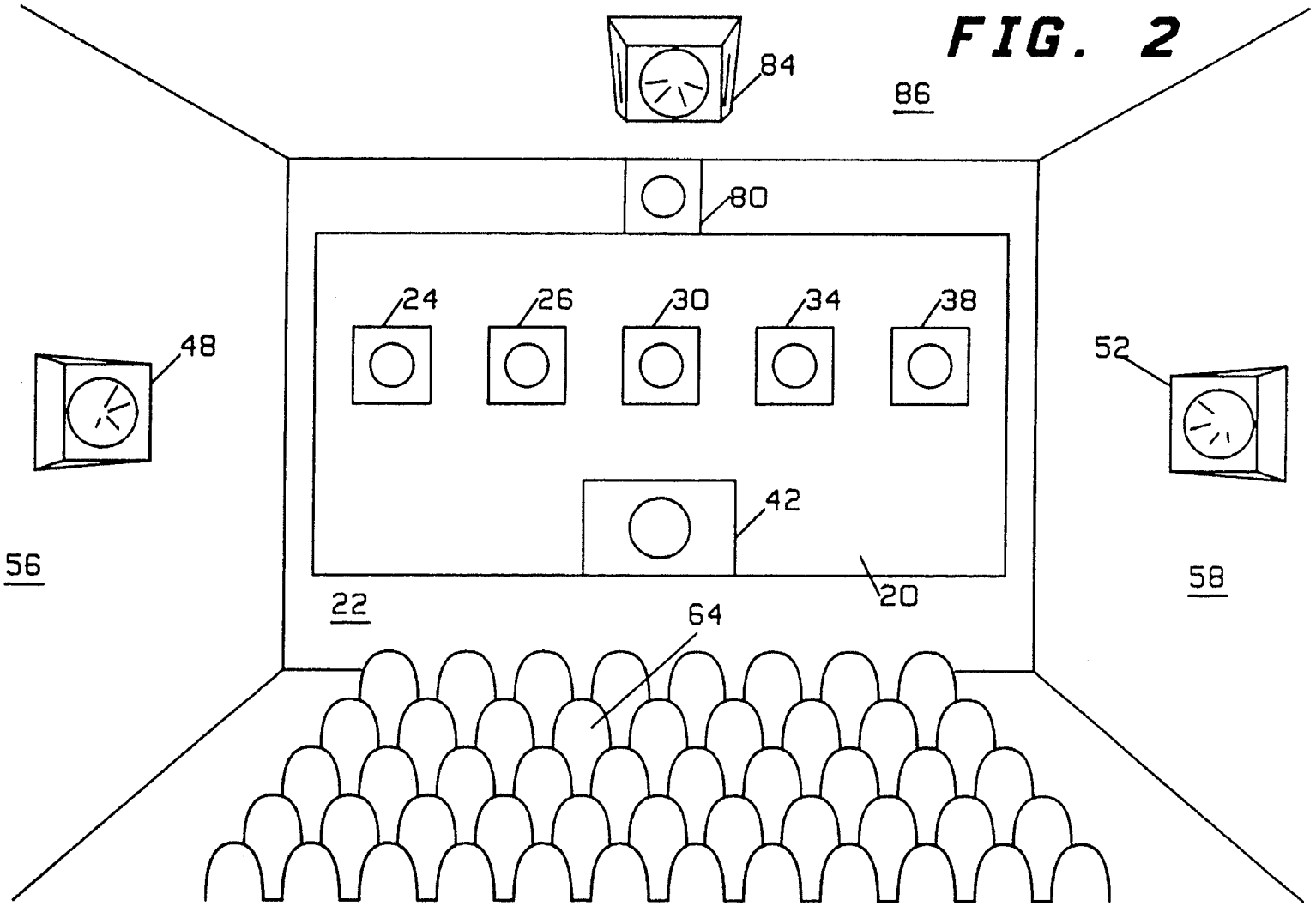
FIG. 2 is an illustration of the theater layout for the surround sound system of the present invention.

A surround sound speaker arrangement according to one embodiment of the present invention is illustrated in FIG. 2. In this arrangement, an additional screen top speaker 80 is added at or near the upper portion of the screen 20 in order to reproduce a "top-center surround channel". Also, a ceiling speaker 84 which attached to the ceiling 86 of the theater is provided for reproducing an "overhead surround channel". Speaker 80 is driven by a separate audio channel referred to herein as a top-center surround channel and speaker 84 is driven by a separate audio channel referred to herein as an overhead surround channel. Collectively and individually, these are referred to as "upper surround channels."

In the present invention, the top-center surround channel and the overhead surround channel are defined to have the same information as the ambience sound which normally is used for the side surround channels. The surround information is then flexibly distributed among the upper and side surround speakers in accordance with a control signal which is encoded, in the preferred embodiment, as a signal level of a pilot signal.

In other embodiments, the top-center surround channel and the overhead surround channel can be used to record and reproduce sounds which naturally emanate from, or have components which emanate from, above the listener. For example, an airplane moving from in front of the listener to above the listener can be reproduced by sounds beginning in the top-center surround channel and moving to the overhead surround channel. For some audio applications, the signal source for these two channels can be separately provided from synchronized audio sources such as dedicated tracks in a tape recording. However, in the case of motion picture audio, this is not currently practical, so the information source for these upper channels shared with the side surround channels.

In the case of motion picture audio, separate tracks of audio could also be provided to drive the top-center surround channel and the overhead surround channel. However, if digital techniques such as those used in SDDS™ are used to provided these channels of audio, these additional tracks are beyond the current practical bandwidth available on conventional motion picture film unless main or surround channel bandwidth is sacrificed. The arrangement shown in FIG. 3 can be used to overcome this problem in an arrangement which the upper surround channels share the surround channel information recorded on the motion picture film with the left and right surround channels.

Figure 3:
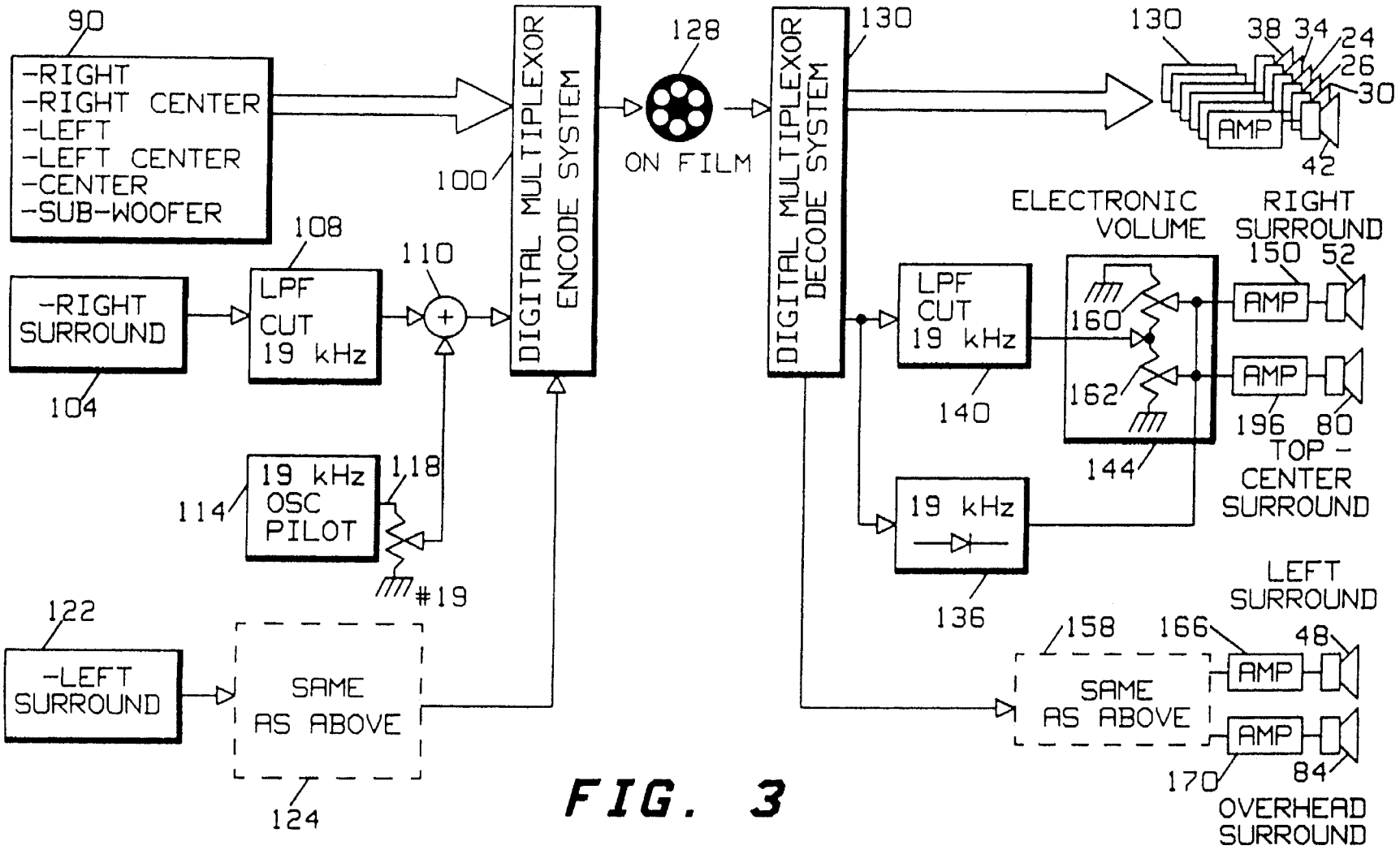
FIG. 3 is block diagram of a first embodiment of the present invention.

In FIG. 3, six channels of audio (right, right center, left, left center, center, and sub-woofer channels) 90 are multiplexed together in a known manner and encoded by a digital multiplexer encoder system 100. In this embodiment, the right surround channel is used to also carry the overhead surround channel information and the left surround channel is used to also carry the top-center surround channel. Due to the symmetry of the system, only the processing of the right surround channel and top-center channel is shown in FIG. 3.

The right surround information 104 is first filtered by a low-pass filter 108 having a cutoff frequency no higher than 19 Khz in the preferred embodiment. This removes information with frequency content greater than 19 Khz from the surround channel (without affecting the other channels). One skilled in the art will recognize that a 19 Khz notch filter could also be used in this first embodiment so as not to significantly affect the upper limits of the bandwidth of the side surround channel. The filtered output of filter 108 is mixed-at an audio mixer 110 with the output of a 19 Khz pilot tone oscillator 114. The output of oscillator 114 is controlled by a variable resistor 118 (e.g. a fader type control), in accordance with the amount of right surround information 104 which should be provided to each of the right surround speaker 52 and the top center surround speaker 84. Information is generally diverted to the upper surround channels during small portions of a motion picture corresponding to the need for sound emanating from overhead. Thus, the variable resistor 118 can be manually controlled to cause the signal to fade from the side surround channels to the upper channels and back manually.

The output of the mixer 110 represents the right surround information plus the pilot signal plus the top center channel information. This mixer output is encoded by encoder system 100 along with the other channels of audio information as if it were conventional right Surround channel information. A similar system 124 is used to process the left surround channel information 122 mixing a pilot signal and overhead surround channel information.

The encoded information from 100 is optically recorded on film using the Sony SDDS™ or other suitable process at 128. (Analogously, the information could be magnetically recorded on audio or video tape.) When the film is played, the right, right center, left, left center, center and sub-woofer channels are decoded at decoder 130 and diverted to six individual amplifiers (shown collectively as 130) and on to speakers 38, 34, 24, 26, 30 and 42 respectively in a conventional manner. The right surround and left surround channels are processed in the manner illustrated in detail in connection with the right surround / top-center channel. The information encoded for the right surround / top-center surround channel is sent to a 19Khz detector 136. This detector 136 is a conventional AC to DC type detector which can be comprised of a 19 Khz high-pass or band-pass filter followed by a rectifier and a low-pass filter. The output voltage of the detector 136 is proportional to the amplitude of the 19 Khz pilot signal at the input of mixer 110.

The 19 Khz signal is preferably recorded at a level no higher than −10 db relative to the maximum signal level for the audio channels in order to avoid beating problems with other recorded signals. Thus, a signal level of −-10 db is indicative that the entire surround channel information is to be fed to the upper surround channel rather than the side surround channel. Of course, other signal level definitions are also possible.

The right surround / top-center channel information is also passed through a 19 Khz low-pass filter 140 (or notch filter) which reduces the level of the 19 Khz energy to at least a level which is not significantly audible. The output of the low-pass filter 140 is processed by an electronic volume control 144 which controls the level of right surround information sent to the input of an amplifier 150 which drives right surround speaker 52. Simultaneously, the electronic volume control 144 controls the level of top-center surround channel information provided to an amplifier 156 which drives speaker 80.

The electronic volume control 144 is symbolically shown as a pair of series variable resistors 160 and 162 which are connected together at one end of each resistor at the point being driven by the output of low-pass filter 140. Each remaining free end of resistors 160 and 162 are connected to ground. The wiper terminals of each resistor are ganged together and controlled by the output of detector 136 such that all of the signal from filter 140 can be used to drive amplifier 150 or amplifier 156. Or, any mixture of signals can be provided to amplifiers 150 or amplifier 156. The combined left surround / overhead surround channels are controlled in an identical manner at 158 similarly using a filter, detector and electronic volume control arrangement to provide output signals to a left surround amplifier 166 driving speaker 48 and an overhead surround amplifier 170 driving speaker 84.

In the preferred embodiment, the overhead surround channel and the top-center surround channel (the overhead surround channel and the top-center surround channel are referred to collectively and individually as upper channels, and the left and right surround channels are referred to collectively and individually as side surround channels) are normally turned off. This corresponds to the condition in which the level of 19 Khz signal is zero. This selection allows the 19 Khz pilot to only be present when needed for the upper channels and is otherwise absent so that it remains inaudible even in the presence of imperfect filtration at filter 140. Restated, the surround signals are sent only to the left and right surround speakers when the 19 Khz pilot signal level is zero. When only top center surround and overhead surround signals are used, the 19 Khz pilot signal should be maximum, preferably 10 db below the maximum allowable signal level. However, this is not to be limiting since the exact opposite could also be used. Also, the choice of 19 Khz is also not to be limiting since other pilot signal frequencies could be used. Using this scheme, the level of signal provided to the upper surround channels is related to the level of the pilot signal and the level of the side surround signal is inversely related to the level of the pilot signal. In one embodiment, this relationship may be approximately that of proportionality. In another embodiment, the relationship is approximately proportional to a logarithm of the signal level. Other relationships may also be suitable.

In the above embodiment, the right surround channel and left surround channel provide identical information for both these channels and the top center surround and the overhead surround channel. Thus, the top-center surround channel and the overhead surround channel are identical to the information supplied to the right and left surround channels respectively. To more accurately produce the desired effect, these side surround channels should be appropriately mixed with specific upper channel information. A good simulation of the effect can be obtained using the conventionally recorded side surround channel information to drive the upper surround channels. However, such an embodiment may lead to some error in vertical sound imaging. This potential problem can be reduced or eliminated by using the arrangement shown in FIG. 4 in which both channels are mixed as a monaural signal in a mixer 184. The mixed signal is then supplied to both the top-center surround amplifier 156 and the overhead surround amplifier 170. In this embodiment, unfortunately, the signal provided to both upper channels is at an identical level.

Figure 4:
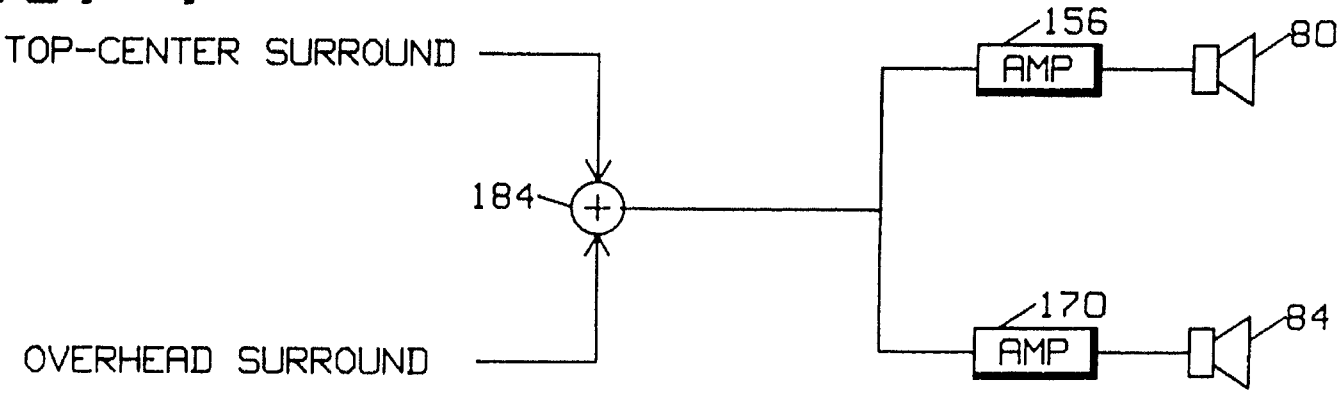
FIG. 4 illustrates a variation of the present invention.
Figure 5:
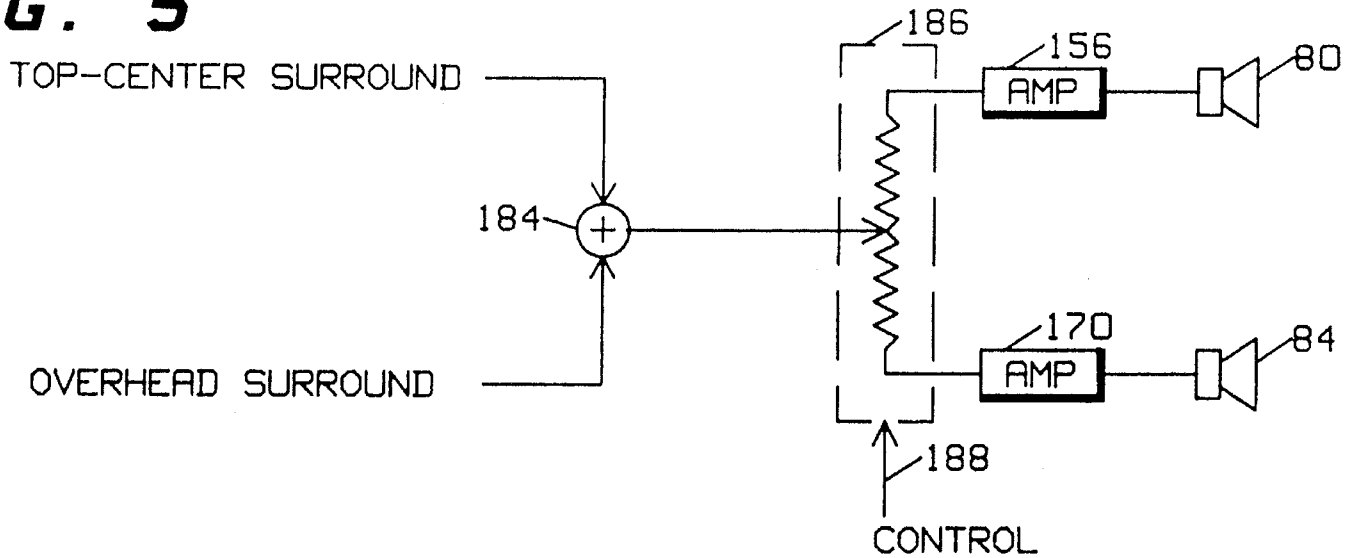
FIG. 5 illustrates a second variation of the present invention.

FIG. 5 illustrates another embodiment wherein an additional electronic volume control is used to control the ratio of the signals being sent to the overhead surround channel and the top-center surround channel after they are mixed as in FIG. 4. This provides the ability to pan from top-center to overhead as desired. In this embodiment, electronic volume control 186 is controlled by a control signal 188 to selectively adjust the level of signal provided to the top-center surround channel and the overhead surround channel. The input of the electronic volume control 186 is a mixture of the top-center surround channel and the overhead surround channel created by mixer 184 as in the system of FIG. 4 and as will be seen more clearly in FIG. 6.

Figure 6:
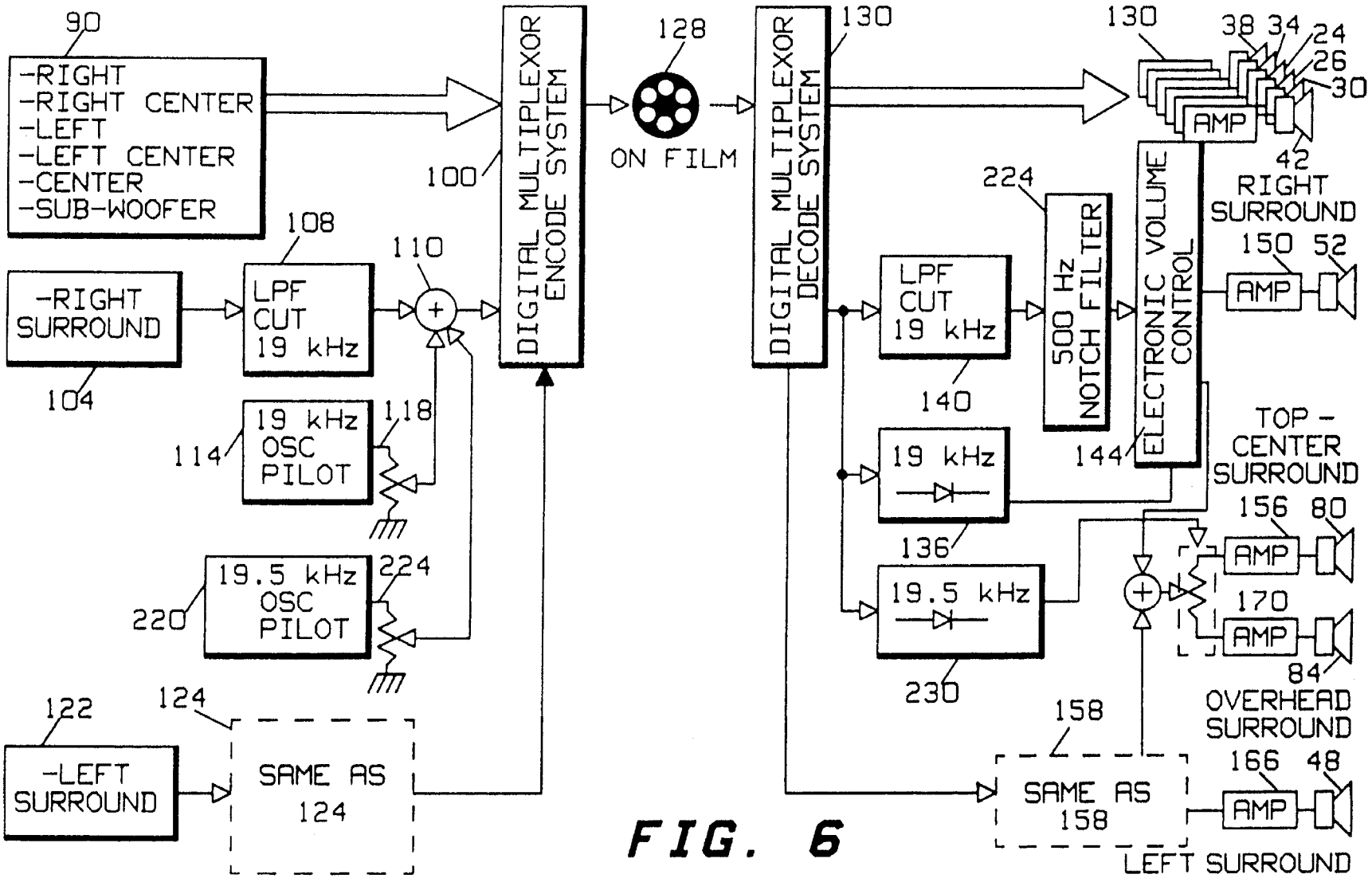
FIG. 6 is a block diagram of another embodiment of the present invention.

Turning to FIG. 6, the alternative embodiment of the present invention using the control scheme shown in FIG. 5 is shown. In this embodiment, an additional pilot signal at 19.5 Khz is produced by oscillator 220 and passed through a control 224 to control the relative recording level for the top-center surround channel and the overhead surround channel. The left surround channel is processed in 124 identical to that of FIG. 5. As with the pilot signal produced by oscillator 114, it is also preferred that the 19.5 Khz signal level be equal to zero unless one or more of the upper channels are to be active. This similarly prevents the 19 Khz and 19.5 Khz signals (and beat signals created thereby) are completely avoided unless the upper channels are needed, which is presumed to be a relatively small part of a typical motion picture.

When the optically encoded signal is decoded at decoder 130, the filter 140 produces a signal which essentially is free of both the 19 Khz and 19.5 Khz pilot signals. However, these two pilots may produce a small level of beat signal at 500 Hz. This beat signal is removed by a narrow bandwidth 500 Hz notch filter 224. The notch filter should be narrow in bandwidth in order to produce minimal disturbance of the audio frequency spectrum to be reproduced by the surround channels. A 19.5 Khz detector 230 is provided with its input in parallel with the 19 Khz detector 136 to produce an additional control signal 188 which controls the electronic volume control 186. Volume control 186 controls the ratio of signal provided to amplifiers 156 and 170. The input of the electronic volume control 186 is the output of mixer 184 which receives the signal for the top-center surround channel and the overhead surround channel. Mixer 184 mixes these two upper surround channels to produce a monaural signal. The left surround channel is produced as in FIG. 5.

Figure 7:
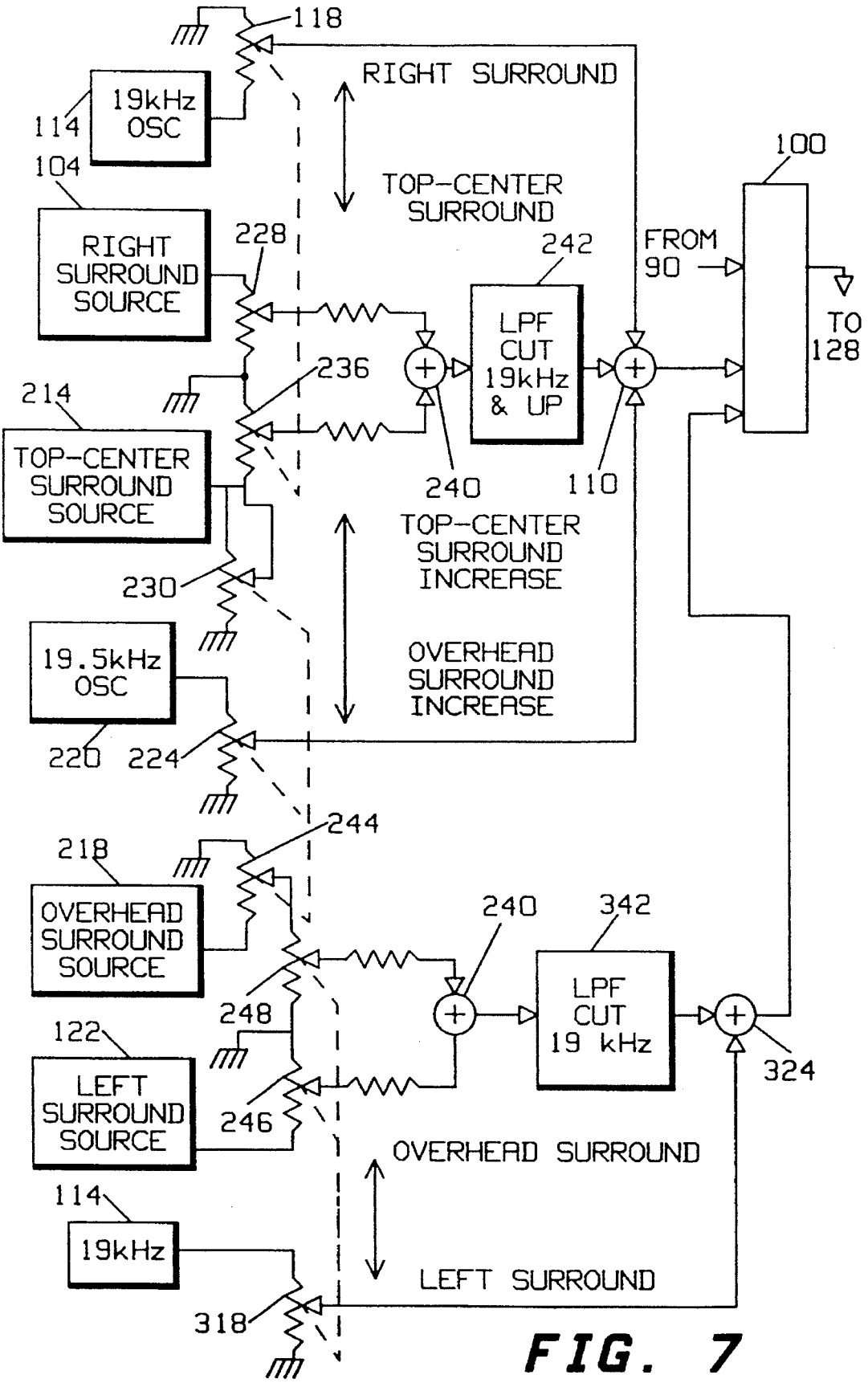
FIG. 7 is a block diagram of an alternative mixing arrangement for mixing upper surround, side surround and pilot signals.

Referring to FIG. 7, an alternative mixing arrangement is shown for mixing upper surround channel information with side surround channel information. In the above examples, it has been primarily presumed that the program material for the side surround channels is suitable for diversion to the upper surround channels. The arrangement of FIG. 7 provides one technique for mixing separate program material for the upper channels as required. This is illustrated in terms of mixing the right surround information from 104 with a source 214 of top-center surround information. The overhead surround source 218 is mixed with left surround source 122.

In this illustration a source of right surround audio 104 is provided along with sources of top-center surround audio 214 and a source of the 19 Khz pilot signal 114. Resistor 118 controls the level of pilot signal from 114 which is applied to mixer 110. Resistors 228 and 230 control the output levels from right surround source 104 and top-center surround source 214 respectively. Resistor 236 controls the balance between top-center surround source 214 and right surround source 104. Resistors 118, 228 and 236 are ganged together as a single control which overall controls the distribution of right surround and top-center surround information provided to low pass filter 242. The mixture of right surround and top-center surround information is provided to mixer 110.

Resistor 244 controls the output level from overhead surround source 218 applied to a resistor 248. Resistor 246 controls the amount of output from the left surround source 122 applied to the other end of resistor 248. Resistor 318 controls the output of 19Khz oscillator 114 applied to a mixer 324. The output of resistors 246 and 248 are mixed together at mixer 340. The output of mixer 340 is low pass filtered by filter 342 and then applied to a mixer 342. Mixer 342 mixes this signal together with the pilot signal from resistor 318. The outputs of mixers 110 and 324 are processed by encoder 100 as previously described.

Resistors 230, 224 and 244 are ganged together to control the balance between top-center surround and overhead surround channel information. Resistors 246,248 and 318 are similarly ganged together to control the balance between overhead surround information and left surround information.

Using this arrangement, the operator can control the mixture of all surround channels using three ganged controls to balance right and top-center surround information, top-center and overhead surround information and overhead and left surround information.

The embodiments described provide a vertical sound image which is not currently provided in conventional theater sound systems. Since the electronic volume controls essentially eliminate the output of the top center surround speaker and the overhead surround speaker when not in use, the additional sound imaging is provided without significant addition of noise into the system. In the preferred embodiment, the system is installed at the output stages of the right and left surround channels making the system simple to retrofit into existing systems without replacement of existing sound systems.

The level of the effect is controlled by adjustment of level of the pilot tones at 118 and 224 (and similarly for the left surround channels). This can be done at or after the final dubbing stage of production in a manner similar to that used by audio engineers to adjust pan pots.

While all of the above discussion assumes that the improved surround sound system includes each of the right, right center, center, left, left center and sub-woofer channels, it will be clear to those skilled in the art, that other arrangements are also suitable. For example, a functional system might include only left and right main channels, left and right surround channels and an upper surround channel situated at either a top-center location or an overhead or top-rear location.

The above discussion assumes that the right surround channel is converted into the right surround channel and the top-center channel, and the left surround channel is converted into the left surround channel and the overhead channel. However, those skilled in the art will appreciate that the relationship between the left and right surround channels and the overhead and top-center surround channels could equally well be reversed. Also, those skilled in the art will understand that the relative levels of the overhead surround and top-center surround channels compared with each other and with the left surround and right surround channels are controlled by the amplitude of the pilot signal. However, these relationships could equally well be encoded by the phase or frequency of the pilot signals in other embodiments. Similarly, sub-audible frequencies could also be used as pilot signals or other frequencies besides those explicitly called out could be used without departing from the invention. Similarly, the oscillators, filters, detectors, volume controls, etc. described herein may be implemented using analog circuits or digital circuits as desired. Also, although the present invention illustrates two upper surround channels, additional upper channels or channels representing other three dimensional images could be similarly encoded using a plurality of pilot signals to control the routing of the surround channel information.

Thus it is apparent that in accordance with the present invention, an apparatus that fully satisfies the objectives, aims and advantages is set forth above. While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A method of audio recording, comprising the steps of:

providing a channel of audio information suitable for serving as a source of side surround audio and upper surround audio;

producing a pilot signal having a characteristic representative of a desired proportion of said channel which should be allotted to said side surround audio and said upper surround audio, wherein said pilot signal is a tone of predetermined frequency having an amplitude ranging from zero to a predetermined maximum value, wherein a zero level in said pilot signal represents a zero level of said upper surround audio and said predetermined minimum value of said pilot signal represents a zero level of said side surround audio and wherein a level of said pilot signal between zero and said predetermined maximum value represents a mixture of non-zero levels of both said side surround channel and said upper surround channel; and recording said pilot tone and said channel of audio.

2. The method of claim 1, further comprising the step of mixing said pilot signal with said channel prior to said recording step.

3. The method of claim 1, wherein said predetermined characteristic includes the amplitude of said pilot signal.

4. The method of claim 1, wherein said pilot signal is a tone of predetermined frequency.

5. An audio system, comprising:

means for receiving a mixed signal including an audio signal mixed with first and second pilot signals;

means for detecting a level of said first pilot signal;

means for detecting a level of said second pilot signal;

means for dividing said audio signal into first and second audio signals, said first audio signal having an amplitude related to said level of said first pilot signal and said second audio signal having an amplitude inversely related to said level of said first pilot signal;

means for mixing said second audio signal with a third audio signal to produce a composite audio signal; and means for dividing said composite audio signal into first and second composite audio signals, said first composite audio signal having an amplitude related to said level of said second pilot signal and said second composite audio signal having an amplitude inversely related to said level of said second pilot signal.

6. The apparatus of claim 5, further comprising a filter for removing said pilot signal from said mixed signal to produce an audio signal.

7. The apparatus of claim 5, wherein said filter includes a low-pass filter.

8. The apparatus of claim 5, wherein said pilot signal includes a 19 Khz tone.

9. The apparatus of claim 5, further comprising a first amplifier for amplifying said first audio signal and a second amplifier for amplifying said second audio signal.

* * * * *